US010185279B1

(12) United States Patent
Sadik et al.

(10) Patent No.: US 10,185,279 B1
(45) Date of Patent: Jan. 22, 2019

(54) GROUNDING DEVICE WITH ELECTRICALLY CONDUCTIVE CUSHION

(71) Applicant: Xerox Corporation, Norwalk, CT (US)

(72) Inventors: Jonathan D. Sadik, Rochester, NY (US); Nancy L. Belknap, Rochester, NY (US); Karl E. Kurz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/653,134

(22) Filed: Jul. 18, 2017

(51) Int. Cl.
*G03G 15/00* (2006.01)
*H01R 39/64* (2006.01)
*H01R 39/02* (2006.01)

(52) U.S. Cl.
CPC ..... *G03G 15/80* (2013.01); *G03G 15/75* (2013.01); *H01R 39/025* (2013.01); *H01R 39/64* (2013.01)

(58) Field of Classification Search
CPC ..... G03G 15/80; G03G 15/75; G03G 15/751; H01R 39/025; H01R 39/64
See application file for complete search history.

(56) References Cited

U.S. PATENT DOCUMENTS 4,561,763 A 12/1985 Basch
5,729,792 A * 3/1998 Ikehara ..... G03G 15/751 174/51
5,815,773 A 9/1998 Zaman
5,943,527 A 8/1999 Kashiwagi et al.
6,006,053 A * 12/1999 Ikehara ..... G03G 15/751 174/51
6,351,620 B1 * 2/2002 Miyabe ..... G03G 21/1853 399/111
6,785,489 B2 8/2004 Anderson, II
7,103,297 B2 9/2006 Guy et al.
7,431,306 B2 10/2008 Ueta et al.
8,422,913 B2 4/2013 Tanaka et al.
2006/0165436 A1 * 7/2006 Nishimura ..... G03G 15/751 399/117
2011/0103837 A1 * 5/2011 Toyoda ..... G03G 15/751 399/174
2012/0213544 A1 * 8/2012 Ooyoshi ..... G03G 15/751 399/90

* cited by examiner

*Primary Examiner* — Sandra Brase
(74) *Attorney, Agent, or Firm* — Gibb & Riley, LLC

(57) ABSTRACT

An exemplary grounding device includes an electrically conductive planar member having a hollow, central opening. Arms extend from inner edges of the hollow, central opening of the planar member. Each arm is angled relative to a surface of the planar member and each arm includes a facing portion having an electrically conductive cushion attached thereto. Each arm is approximately the same size and is configured to contact a shaft extending through the hollow, central opening of the planar member to form an electrical connection between the planar member and the shaft. The electrically conductive cushion is between the arm and the shaft. A tab projection extends from an outer edge of the planar member. Each tab projection is in the same plane as the planar member.

20 Claims, 5 Drawing Sheets

GROUNDING DEVICE WITH ELECTRICALLY CONDUCTIVE CUSHION

BACKGROUND

Devices herein generally relate to xerographic or electrostatographic printing machines, and more particularly to a drum unit and a grounding device used in the drum unit, which are used in image forming apparatuses, such as copying machines, laser printers, and facsimile machine.

In an image forming apparatus, for example a copying machine, an original image or document is usually read by an exposure section to form an electrostatic latent image on a photosensitive drum. A developing unit for forming toner image is disposed about an outer circumference of the photosensitive drum. The developing unit develops the read image by charging toner supplied from a toner hopper so that it has an electrostatic charge that is opposite that of the electrostatic latent image on the photosensitive drum. The toner adheres to the photosensitive drum at oppositely charged portions of the drum corresponding to the electrostatic latent image through a developing sleeve.

Electrophotographic imaging members are well known in the art. One type of photoreceptor conventionally utilized for copiers and printers and the like comprises a hollow photosensitive drum. The drum includes a tube that is obtained by forming a conductive metal into a cylindrical shape. Typically, the drum has been dip coated with various coatings including at least one photosensitive coating. These photoreceptors are usually supported on an electrically conductive shaft by drum supporting hubs or end flanges. The hubs can be constructed of metal, which is very robust to fatigue effects and deformation due to interference with the drive shaft. Hubs provide excellent stability and efficient grounding over the part life, however these parts are not cost effective. Hubs made of plastic material are lower cost and have a hole through their center into which a supporting axle shaft is inserted. That is, a flange member is forced into openings at opposing ends of the drum tube to provide the interface to a driving mechanism for rotation of the drum. Hubs constructed of metal provide a direct grounding connection to the metal substrate, while hubs constructed of electrically insulating plastic material require an electrical grounding device, which can be secured to the hub and positioned to contact both the electrically conductive axle shaft and the electrically conductive metal substrate of the photosensitive drum.

To produce a conductive state between the drum tube and the apparatus body, an electrical grounding device, sometimes referred to as an earth plate or ground plate, may be attached to the flange member. The ground plate part provides a ground path from the photosensitive drum tube through the drive shaft. The ground plate has an outer peripheral contact portion that is configured to contact the drum tube. An inner contact portion of the ground plate is configured to be in contact with the periphery of the drive shaft.

Ground plate devices can be constructed of various metals including, aluminum, copper, bronze, stainless steel, and the like. Material selection is key to providing a good reliable contact with the shaft, to be robust against corrosion in various environments, and withstand frictional stress during machine operation. Any intermittent loss of contact between the ground plate and the drive shaft will result in image quality defects on the printed output. Some ground plate devices are susceptible to this type of defect due to misalignment of the motor drive shaft. The misalignment induces a wobble type motion of the drive shaft relative to the ground plate and causes the ground plate contact pieces to vibrate or slide back and forth against the drive shaft. This relative surface motion, at an interface, which is supposed to be static, induces fretting corrosion, which can impede electrical continuity, even with good contact, which then results in image defects, as well as inducing other electrical noise issues within the image forming apparatus.

Therefore, a need exists for a grounding device that can maintain electrical contact with the drive shaft in the event of misalignment and avoids metal-to-metal friction with the drive shaft.

SUMMARY

A compliant, conductive material, applied to the contact point of the grounding device acts as a buffer between the grounding device and drive shaft. The electrically conductive material can be made of foam embedded with electrically conductive fibers, non-conductive foam wrapped in an electrically conductive cover, conductive plastic, rubber, and the like. The compliant material eliminates metal-to-metal friction at the contact interface of the sort that causes fretting and thus the possibility of corrosion. Further, the compliant material provides a cushioning effect to account for misalignment of the drive shaft.

Exemplary devices disclosed herein include a conductive photosensitive drum and a circular flange attached to an end of the conductive photosensitive drum. The circular flange has a first portion with a first diameter for protruding above a surface of the conductive photosensitive drum and a second portion with a second diameter for inserting into an inside diameter of the conductive photosensitive drum. The second diameter is relatively smaller than the first diameter. The circular flange has an aperture centrally located therein. A grounding device is mounted in the circular flange. The grounding device includes a planar member made of electrically conductive material having a hollow, central opening. A drive shaft extends into the conductive photosensitive drum through the aperture of the circular flange and through the hollow, central opening of the grounding device. The grounding device further includes a pair of arms extending from inner edges of the hollow, central opening. Each arm of the pair of arms is angled relative to the surface of the planar member, and each arm of the pair of arms includes a distal end portion having an electrically conductive cushion thereon. The electrically conductive cushion contacts the drive shaft and forms an electrical connection between the grounding device and the drive shaft. The grounding device further includes a pair of tab projections that extend from outer edges of the planar member. Each tab projection of the pair of tab projections is in the same plane as the planar member. Each tab projection of the pair of tab projections is folded over the second portion of the circular flange and forms an electrical connection between the grounding device and the conductive photosensitive drum.

Exemplary image forming devices herein include a printer engine and a photosensitive drum assembly mounted in the printer engine. The photosensitive drum assembly includes a cylindrical drum having a photosensitive layer on an outer surface thereof. The photosensitive drum assembly includes a first end cap and a second end cap. Each of the end caps is configured to fit into opposite ends of the cylindrical drum. A drive shaft extends into the cylindrical drum through the first end cap. A grounding device made of electrically conductive material is fixed to an inner face of the first end cap. The grounding device includes a planar member having a central opening. A pair of arms extends from inner edges of the central opening. Each arm of the pair of arms includes a distal end portion having an electrically conductive cushion thereon. The electrically conductive cushion contacts the drive shaft and forms an electrical connection between the grounding device and the drive shaft. A pair of tab projections extends from outer edges of the planar member. Each tab projection of the pair of tab projections is in the same plane as the planar member. Each tab projection of the pair of tab projections is folded over a lip of the first end cap and forms an electrical connection between the grounding device and the cylindrical drum.

An exemplary grounding device herein includes an electrically conductive planar member having a hollow, central opening. Arms extend from inner edges of the hollow, central opening of the planar member. Each arm is angled relative to a surface of the planar member and is approximately the same size. Each arm includes a distal end portion having an electrically conductive cushion thereon. The electrically conductive cushion is positioned to contact a shaft extending through the hollow, central opening of the planar member to form an electrical connection between the planar member and the shaft. A tab projection extends from an outer edge of the planar member. Each tab projection is in the same plane as the planar member.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
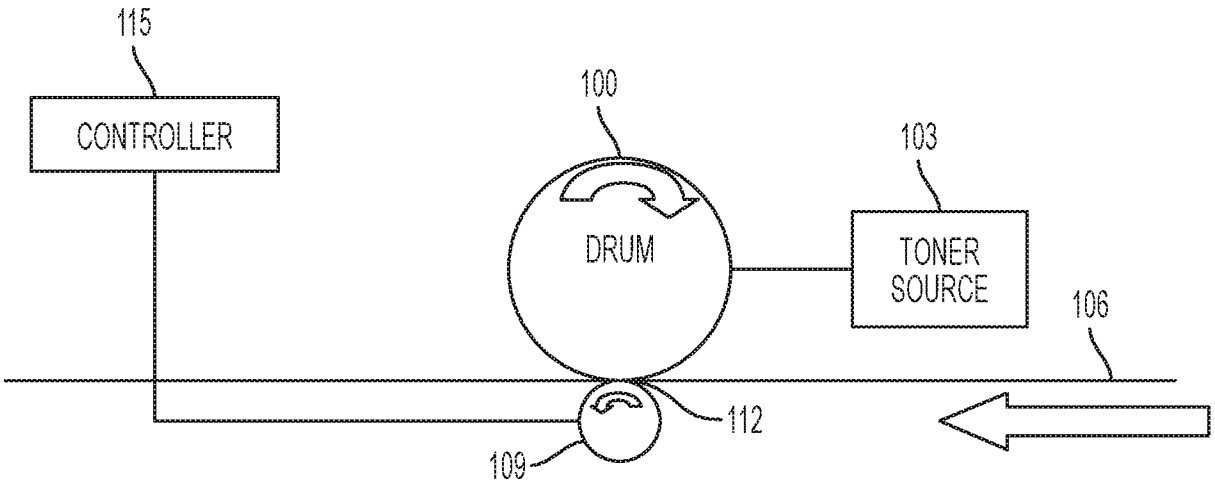
FIG. 1 is a schematic diagram of an electrostatic imaging system according to devices herein.

The disclosure will now be described by reference to a multi-function device that includes an automatic document handler. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

For a general understanding of the features of the disclosure, reference is made to the drawings. In the drawings, like reference numerals have been used throughout to identify identical elements.

Referring to FIG. 1, a simple electrostatic imaging system is shown, which can be used with devices and methods herein and can comprise, for example, a printer, copier, fax machine, multi-function device (MFD), etc. An electronic or optical image or an image of an original document or set of documents to be reproduced may be projected or scanned onto a charged surface of a photoreceptor drum 100 to form an electrostatic latent image. The latent image is developed with developing material from a toner source 103 to form a toner image corresponding to the latent image. More specifically, a sheet of print media is fed from a selected media sheet tray having a supply of paper to a sheet transport for travel to a transfer station including the photoreceptor drum 100. There, the toned image is electrostatically transferred to the print media. In other words, a surface, such as a printing medium 106, is moved adjacent to (and/or in contact with) the photoreceptor drum 100 and toner is transferred to the printing medium 106 with the assistance of a charged transfer device 109. That is, by operation of the charge induced into the printing medium 106 by the charged transfer device 109, oppositely charged toner is attracted from the photoreceptor drum 100 to the printing medium 106 as the printing medium 106 passes through the nip 112 created between the photoreceptor drum 100 and the charged transfer device 109. The toner remains on the printing medium 106 after it passes through the nip 112, and is fused to the printing medium 106. A controller 115 is connected to the charged transfer device 109 to control operation of the electrostatic imaging system while varying the transfer field of the charged transfer device 109.

As would be understood by those ordinarily skilled in the art, the electrostatic imaging system shown in FIG. 1 is only one example and the devices and methods herein are equally applicable to other types of printing devices that may include fewer components or more components. For example, while a single photoreceptor drum 100 and paper path are illustrated in FIG. 1, those ordinarily skilled in the art would understand that many more paper paths and additional photoreceptor drums 100 could be included within any printing device used with devices and methods herein.

In other words, an exemplary imaging system comprises a multifunctional device with print, copy, scan, and fax services. Such multifunctional devices are well known in the art and may comprise print engines based upon liquid or solid ink jet, electrophotography, other electrostatographic technologies, and other imaging technologies. The general principles of electrophotographic imaging are well known to many skilled in the art and are described above as an example of an imaging system to which the present concepts is applicable.

It should be understood that the controller 115 as used herein may comprise a computerized device adapted to perform (i.e., programmed to perform, configured to perform, etc.) the below described system operations. According to devices and methods herein, the controller 115 comprises a programmable, self-contained, dedicated mini-computer having a central processor unit (CPU). Computerized devices that include chip-based central processing units (CPU's) are well-known and readily available devices produced by manufacturers such as Dell Computers, Round Rock Tex., USA, and Apple Computer Co., Cupertino Calif., USA. The details of such computerized devices are not discussed herein for purposes of brevity and reader focus.

Figure 2:
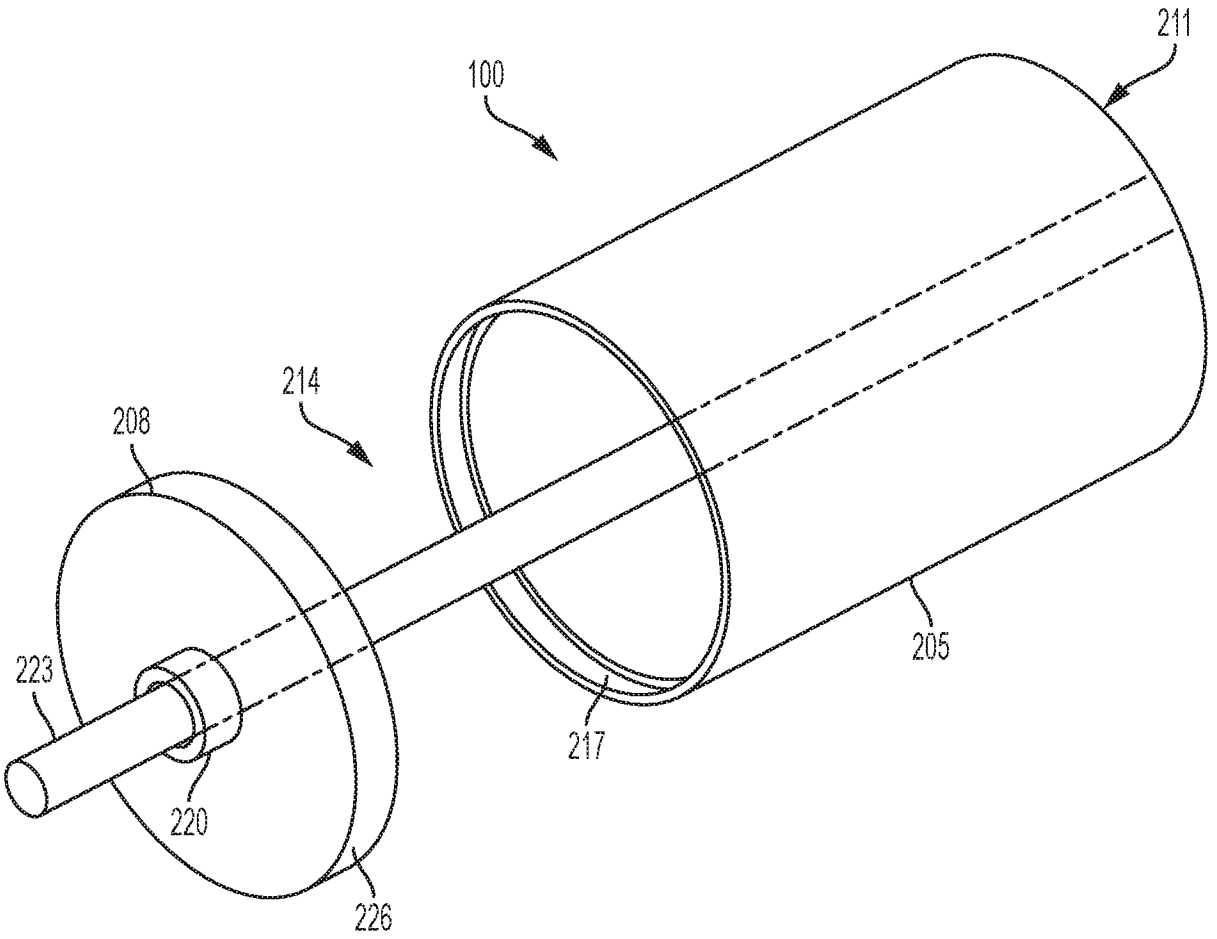
FIG. 2 is a perspective view of a typical photoreceptor drum.

FIG. 2 shows a photoreceptor drum 100, on the surface of which an electrostatic latent image is formed. The photoreceptor drum 100 has a photosensitive drum tube 205 and flanges 208, 211. The photosensitive drum tube 205 is obtained by forming a conductive metal into a cylindrical shape. The photosensitive drum tube 205 can have a photosensitive layer, for example an organic photoconductor (OPC), formed on the peripheral surface of the metal tube.

Openings, such as 214, are formed on the ends of the photosensitive drum tube 205, and fittings, such as 217, having a specific length and a smaller wall thickness are provided on the ends of the openings 214. In the center of the flange 208, an aperture or support hole 220 is provided. The support hole 220 is fitted with a drive shaft 223 in order to support and rotate the photosensitive drum tube 205. The peripheral surface of the flange 208 defines a contact portion 226 that is inserted in the fitting 217 of the photosensitive drum tube 205.

Figure 3:
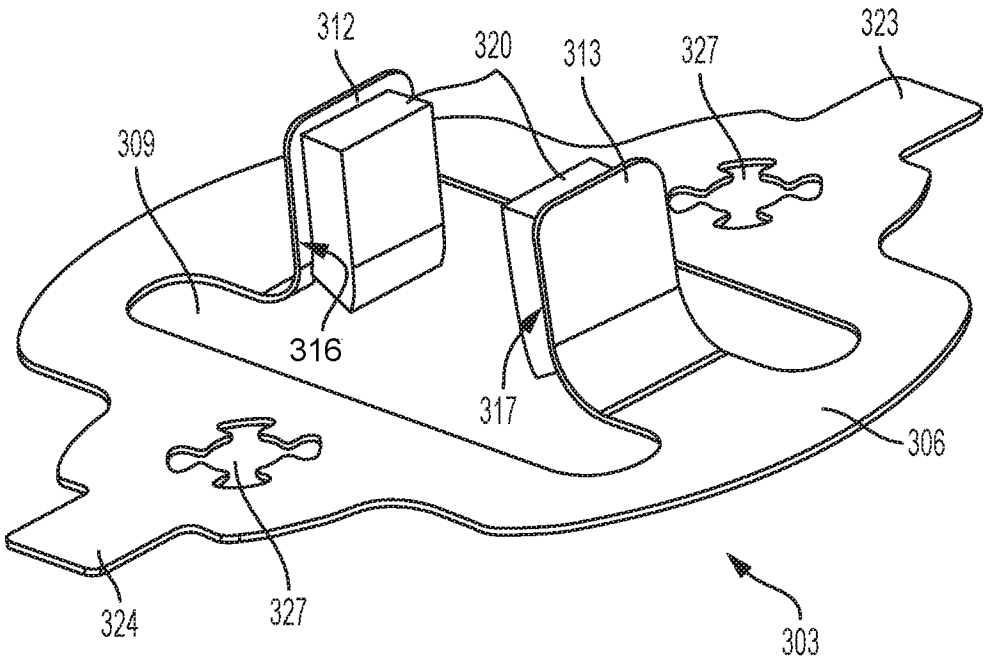
FIG. 3 is a perspective view of an exemplary grounding device according to devices herein.

FIG. 3 shows an exemplary grounding device, indicated generally as 303, according to the present disclosure. The grounding device 303 comprises a planar member 306 that is made of an electrically conductive material. For example, in some cases, the planar member 306 can be made of copper, aluminum, titanium, stainless steel, phosphor bronze, or other appropriate metal. The planar member 306 includes a central opening 309 that is hollow. As shown in FIG. 3, the central opening 309 may be rectangularly shaped. Other appropriate shapes can be used. Arms 312, 313 extend from inner edges of the central opening 309. Each arm 312, 313 is angled relative to a surface of the planar member 306 and includes a facing portion 316, 317 having an electrically conductive cushion 320 attached thereon. The electrically conductive cushion 320 can be a pad made of foam embedded with electrically conductive fibers or non-conductive foam wrapped in an electrically conductive cover. Alternatively, the electrically conductive cushion 320 can be conductive plastic, conductive rubber, and the like on the arms 312, 313. Further, the electrically conductive cushion 320 can be applied to the arms 312, 313 by direct coating application, molding, or other mechanical attachment to the grounding device 303. Each of the arms 312, 313 is approximately the same size and configured so that the electrically conductive cushion 320 contacts the drive shaft 223 extending through the central opening 309 of the planar member 306. The electrically conductive cushion 320 eliminates metal-to-metal friction at the contact interface. As shown in FIG. 3, the arms 312, 313 may comprise spring clips that press against the side of the drive shaft 223 and form an electrical connection between the grounding device 303 and the drive shaft 223, with the electrically conductive cushion 320 being between the arms 312, 313 and the drive shaft 223.

As described above, the electrically conductive cushion 320 can be a pad made of foam embedded with electrically conductive fibers or non-conductive foam wrapped in an electrically conductive cover. For example, the electrically conductive cushion 320 may be made of polyurethane foam coated with copper, nickel, or other appropriate material. The electrically conductive cushion 320 may be attached to the arms 312, 313 using an electrically conductive adhesive. In some cases, the electrically conductive cushion 320 can be directly coated or molded onto the arms 312, 313. The electrically conductive cushion 320 eliminates metal-to-metal contact at the interface between the grounding device 303 and the drive shaft 223 of the sort that causes fretting and thus the possibility of corrosion. Moreover, the electrically conductive cushion 320 can maintain electrical contact with the drive shaft 223 in the event of misalignment of the drive shaft 223 with the flange 208. The flange 208 and the drive shaft 223 are intended to move together so there should be no relative motion between the drive shaft 223 and the grounding device 303. However, the cushioning effect of the electrically conductive cushion 320 can absorb wobble caused by misalignment between the drive shaft 223 and the flange 208.

Figure 4:
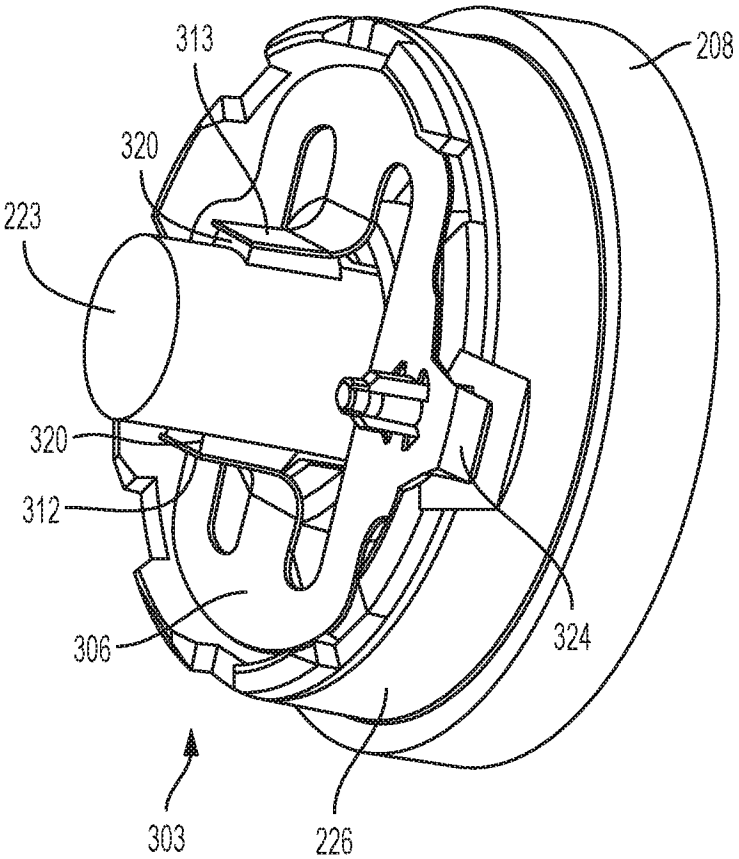
FIG. 4 is a perspective view of a hub flange with an exemplary grounding device according to devices herein.

Tab projections 323, 324 extend from an outer edge of the planar member 306. Each tab projection 323, 324 is in the same plane as the planar member 306. The grounding device 303 may include mounting devices, such as 327, to attach the grounding device 303 to the flange 208. As shown in FIG. 4, each tab projection 323, 324 is then folded over the contact portion 226 of the flange 208 so that the tab projections 323, 324 form an electrical connection between the grounding device 303 and the photoreceptor drum 100. As shown in FIGS. 3 and 4, the arms 312, 313 push the electrically conductive cushion 320 in contact with the drive shaft 223 and provide a path for grounding of the photoreceptor drum 100.

Figure 5:
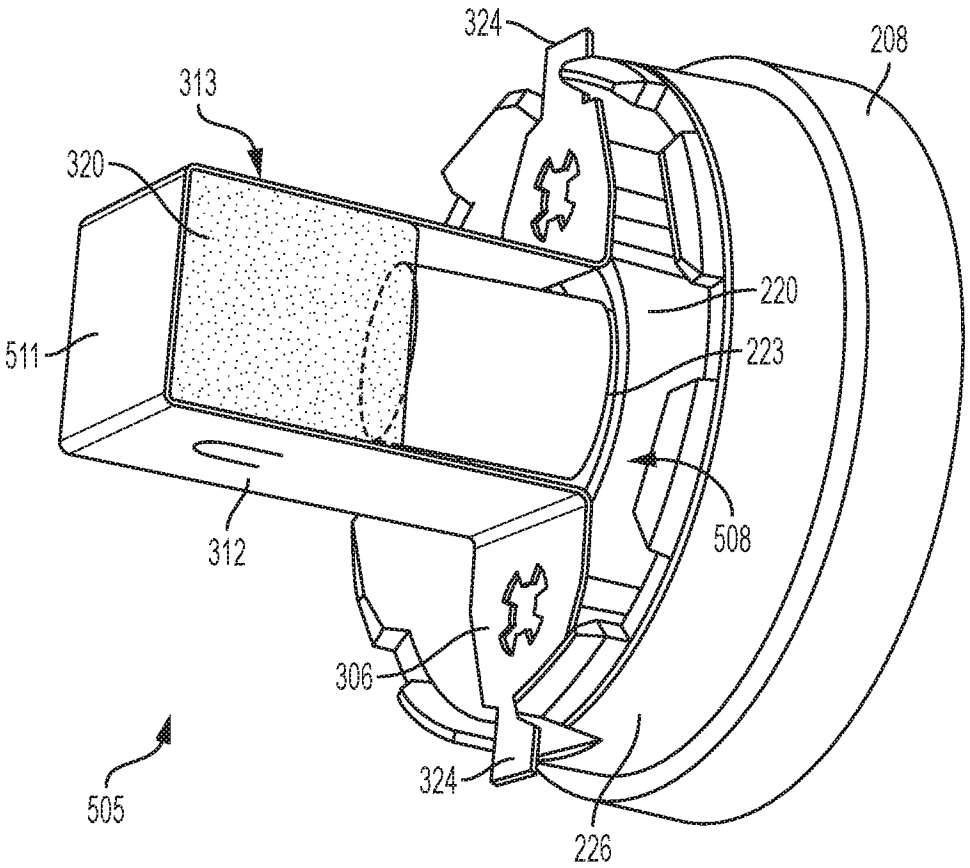
FIG. 5 is a perspective view of a hub flange with another exemplary grounding device according to devices herein.

FIG. 5 shows another exemplary grounding device, indicated generally as 505, according to the present disclosure. The grounding device 505 comprises a planar member 306 that is made of an electrically conductive material. For example, in some cases, the planar member 306 can be made of copper, aluminum, titanium, stainless steel, phosphor bronze, or other appropriate metal. The planar member 306 includes a space 508 between opposing ends of the planar member 306. The space is at least as wide as the support hole 220 in the flange 208 (FIG. 2). Arms 312, 313 extend from inner edges of the space 508. Each arm 312, 313 is angled relative to a surface of the planar member 306 and is approximately the same size. The arms 312, 313 are spaced such that they do not contact the shaft 223 extending through the space 508 in the planar member 306. A bridge 511 connects the distal ends of the arms 312, 313. The bridge 511 may be a flat surface in a plane approximately parallel to the plane of the planar member 306. An electrically conductive cushion 320 is disposed between the arms 312, 313 and may be contacting against the bridge 511. The electrically conductive cushion 320 can be a pad made of foam embedded with electrically conductive fibers or non-conductive foam wrapped in an electrically conductive cover. Alternatively, the electrically conductive cushion 320 can be conductive plastic, conductive rubber, and the like. The electrically conductive cushion may be attached to the arms 312, 313. Alternatively, the electrically conductive cushion may be attached to the bridge. As shown in FIG. 5, the electrically conductive cushion 320 may be configured so that the electrically conductive cushion 320 contacts the end of the drive shaft 223 extending through the space 508 between opposing ends of the planar member 306. The electrically conductive cushion 320 eliminates metal-to-metal friction at the contact interface. The end of the drive shaft 223 may press against the electrically conductive cushion 320 and form an electrical connection between the grounding device 505 and the drive shaft 223, with the electrically conductive cushion 320 being between the arms 312, 313 adjacent to the end of the drive shaft 223.

The electrically conductive cushion 320 can be a pad made of foam embedded with electrically conductive fibers or non-conductive foam wrapped in an electrically conductive cover. For example, the electrically conductive cushion 320 may be made of polyurethane foam coated with copper, nickel, or other appropriate material. The electrically conductive cushion 320 may be attached to the arms 312, 313 or the bridge 511 using an electrically conductive adhesive. In some cases, the electrically conductive cushion 320 can be molded between the arms 312, 313 or mechanically attached between the arms 312, 313. The electrically conductive cushion 320 eliminates metal-to-metal contact at the interface between the grounding device 505 and the drive shaft 223 of the sort that causes fretting and thus the possibility of corrosion. Moreover, the electrically conductive cushion 320 can maintain electrical contact with the drive shaft 223 in the event of misalignment of the drive shaft 323 with the flange 208. The flange 208 and the drive shaft 223 are intended to move together so there should be no relative motion between the drive shaft 223 and the grounding device 505. However, the cushioning effect of the electrically conductive cushion 320 can absorb wobble caused by misalignment between the drive shaft 323 and the flange 208.

Tab projections 323, 324 extend from an outer edge of the planar member 306. Each tab projection 323, 324 is in the same plane as the planar member 306. Each tab projection 323, 324 is folded over the contact portion 226 of the flange 208 so that the tab projections 323, 324 form an electrical connection between the grounding device 303 and the photoreceptor drum 100.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, it is not intended for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well known by those ordinarily skilled in the art and are not described in detail herein to keep this disclosure focused on the salient features presented. The devices and methods herein can encompass devices that print in color, monochrome, or handle color or monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises", "comprising", "includes", and/or "including", when used in this specification, specify the presence of stated features, integers, steps, operations, elements, and/or components, but do not preclude the presence or addition of one or more other features, integers, steps, operations, elements, components, and/or groups thereof.

In addition, terms such as "right", "left", "vertical", "horizontal", "top", "bottom", "upper", "lower", "under", "below", "underlying", "over", "overlying", "parallel", "perpendicular", etc., used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms "automated" or "automatically" mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. A device, comprising:

a conductive photosensitive drum;

a circular flange including a first portion having a first diameter for protruding above a surface of said conductive photosensitive drum and a second portion having a second diameter for inserting into an inside diameter of said conductive photosensitive drum, said second diameter being relatively smaller than said first diameter, said circular flange having an aperture centrally located therein;

a grounding device comprising an electrically conductive plate mounted in said circular flange, said grounding device comprising a planar member having a hollow, central opening; and a drive shaft extending into said conductive photosensitive drum through said aperture of said circular flange and through said hollow, central opening of said grounding device, said grounding device further comprising a pair of arms connected to and extending from inner edges of said hollow, central opening of said planar member, each arm of said pair of arms being angled relative to a surface of said planar member, each arm of said pair of arms including a distal end portion having an electrically conductive cushion thereon, said electrically conductive cushion contacting said drive shaft, said electrically conductive cushion being between each said arm and said drive shaft and forming an electrical connection between said grounding device and said drive shaft, and said grounding device further comprising a pair of tab projections connected to and extending from outer edges of said planar member, each tab projection of said pair of tab projections being in the same plane as said planar member, each tab projection of said pair of tab projections being folded over said second portion of said circular flange and forming an electrical connection between said grounding device and said conductive photosensitive drum.

2. The device according to claim 1, wherein said electrically conductive cushion comprises a foam pad embedded with electrically conductive fibers or a non-conductive foam pad wrapped in an electrically conductive cover.

3. The device according to claim 1, wherein said electrically conductive cushion comprises conductive plastic or conductive rubber.

4. The device according to claim 1, wherein said arms comprise spring clips pressing against an outer surface of said drive shaft, said electrically conductive cushion being between each spring clip and said drive shaft.

5. The device according to claim 1, further comprising:

a bridge connected to said distal end portion of each said arm, said electrically conductive cushion being disposed between said arms and contacting against the bridge, an end of said drive shaft being pressed against said electrically conductive cushion.

6. The device according to claim 1, wherein said electrically conductive cushion is attached to said grounding device using an electrically conductive adhesive.

7. The device according to claim 1, said grounding device further comprising:

mounting devices configured to attach said grounding device to said circular flange.

8. An image forming device, comprising:

a printer engine; and a photosensitive drum assembly mounted in said printer engine, said photosensitive drum assembly comprising:

a cylindrical drum having a photosensitive layer on an outer surface thereof;

a first end cap and a second end cap, each of said end caps being configured to fit into opposite ends of said cylindrical drum;

a drive shaft extending into said cylindrical drum through said first end cap; and a grounding device comprising an electrically conductive plate fixed to an inner face of said first end cap, said grounding device comprising:

a planar member having a central opening, a pair of arms connected to and extending from inner edges of said central opening of said planar member, each arm of said pair of arms being angled relative to a surface of said planar member, and having an electrically conductive cushion attached thereon, said electrically conductive cushion contacting said drive shaft, said electrically conductive cushion being between each said arm and said drive shaft and forming an electrical connection between said grounding device and said drive shaft, and a pair of tab projections connected to and extending from outer edges of said planar member, each tab projection of said pair of tab projections being folded over a lip of said first end cap and forming an electrical connection between said grounding device and said cylindrical drum.

9. The image forming device according to claim 8, wherein said electrically conductive cushion comprises a foam pad embedded with electrically conductive fibers or a non-conductive foam pad wrapped in an electrically conductive cover.

10. The image forming device according to claim 8, wherein said electrically conductive cushion comprises conductive plastic or conductive rubber.

11. The image forming device according to claim 8, wherein said arms comprise spring clips pressing against an outer surface of said drive shaft, said electrically conductive cushion being between each spring clip and said drive shaft.

12. The image forming device according to claim 8, further comprising:

a bridge connected to a distal end portion of each said arm, said electrically conductive cushion being disposed between said arms and contacting against the bridge, an end of said drive shaft being pressed against said electrically conductive cushion.

13. The image forming device according to claim 8, wherein said electrically conductive cushion is attached to said grounding device using an electrically conductive adhesive.

14. The image forming device according to claim 8, said grounding device further comprising:

mounting devices configured to attach said grounding device to said first end cap.

15. A grounding device, comprising:

an electrically conductive planar member, said electrically conductive planar member having a hollow, central opening; and arms connected to and extending from inner edges of said hollow, central opening of said electrically conductive planar member, each of said arms being angled relative to a surface of said electrically conductive planar member, each of said arms being approximately the same size, and each of said arms having an electrically conductive cushion attached thereon said electrically conductive cushion being positioned to contact a shaft extending through said hollow, central opening of said electrically conductive planar member, said electrically conductive cushion being between said arms and said shaft and forming an electrical connection between said electrically conductive planar member and said shaft.

16. The grounding device according to claim 15, wherein said electrically conductive cushion comprises a foam pad embedded with electrically conductive fibers or a non-conductive foam pad wrapped in an electrically conductive cover.

17. The grounding device according to claim 15, wherein said electrically conductive cushion comprises conductive plastic or conductive rubber.

18. The grounding device according to claim 15, wherein said arms comprise clips pressing against an outer surface of said shaft, said electrically conductive cushion being between each clip and said shaft.

19. The grounding device according to claim 15, further comprising:

a bridge connected to distal ends of each of said arms, said electrically conductive cushion being disposed between said arms and contacting against the bridge, said electrically conductive cushion being positioned to contact an end of said shaft being pressed against said electrically conductive cushion.

20. The grounding device according to claim 15, further comprising:

a tab projection connected to and extending from an outer edge of said electrically conductive planar member, said tab projection being in the same plane as said electrically conductive planar member.

* * * * *